US009856001B2

(12) United States Patent
Beer et al.

(10) Patent No.: US 9,856,001 B2
(45) Date of Patent: Jan. 2, 2018

(54) AQUATIC RESCUE DEVICE

(71) Applicant: Rescue Alive, LLC, Spencer, MA (US)

(72) Inventors: Robert Beer, Spencer, MA (US); David Kroll, Westfield, MA (US)

(73) Assignee: RESCUE ALIVE, LLC, Paxton, MA (US)

( * ) Notice: Subject to any disclaimer, the term of this patent is extended or adjusted under 35 U.S.C. 154(b) by 0 days.

(21) Appl. No.: 15/347,149

(22) Filed: Nov. 9, 2016

(65) Prior Publication Data

US 2017/0190401 A1 Jul. 6, 2017

Related U.S. Application Data

(60) Provisional application No. 62/253,068, filed on Nov. 9, 2015.

(51) Int. Cl.

| | |
|---|---|
| ***B63C 9/32*** | (2006.01) |
| ***B63B 17/00*** | (2006.01) |
| ***B63B 1/12*** | (2006.01) |

(52) U.S. Cl.

CPC ..... *B63C 9/32* (2013.01); *B63B 1/121* (2013.01); *B63B 17/00* (2013.01)

(58) Field of Classification Search

CPC .... B63C 9/02; B63C 9/32; B63C 9/00; B63B 2003/085; B63B 5/24; B63B 1/121; B63B 17/00

USPC .... 114/39.28, 61.1, 61.18, 343, 364; 441/82

See application file for complete search history.

(56) References Cited

U.S. PATENT DOCUMENTS

| | | | | |
|---|---|---|---|---|
| 3,711,879 | A | 1/1973 | Siefert | |
| 3,864,770 | A * | 2/1975 | Zeilinger | B63B 27/14 114/355 |
| 4,046,091 | A * | 9/1977 | Lomas, III | B63B 3/48 114/355 |
| 4,079,953 | A | 3/1978 | Howarth, Jr. | |
| 4,179,764 | A | 12/1979 | Lindblade | |
| 4,936,241 | A * | 6/1990 | Hendrickson | B63B 17/00 114/343 |
| 4,968,046 | A | 11/1990 | O'Connell et al. | |
| 5,320,567 | A | 6/1994 | Beer | |
| 5,427,557 | A | 6/1995 | Lunden, Sr. | |
| 5,624,292 | A | 4/1997 | Wiseman, Jr. | |
| 5,807,153 | A | 9/1998 | Allen et al. | |
| 6,190,222 | B1 | 2/2001 | Senger | |
| 6,641,446 | B1 | 11/2003 | Bentley | |
| 6,764,363 | B2 | 7/2004 | Rosen | |
| 7,121,910 | B2 | 10/2006 | Rosen | |
| 7,247,070 | B2 | 7/2007 | Boice | |
| 8,167,668 | B2 | 5/2012 | Robicheaux | |
| 8,469,015 | B2 | 6/2013 | Gerwig | |
| 8,499,707 | B2 | 8/2013 | Halfon | |
| 8,636,554 | B1 | 1/2014 | Connolly et al. | |

(Continued)

FOREIGN PATENT DOCUMENTS

WO 2002081301 A2 10/2002

*Primary Examiner* — Lars A Olson

(74) *Attorney, Agent, or Firm* — Duquette Law Group, LLC

(57) ABSTRACT

A rescue device, comprises a frame and at least one flotation element connected to the frame. The at least one flotation element defines a chamber containing a volume of air and includes at least one vertical load support extending between a first flotation element portion and an opposing second flotation element portion of the flotation element.

19 Claims, 11 Drawing Sheets

(56) References Cited

U.S. PATENT DOCUMENTS

| | | | | |
|---|---|---|---|---|
| 8,668,535 | B1 | 3/2014 | Scroggs | |
| 9,056,661 | B2 | 6/2015 | Macri | |
| 2010/0011507 | A1 | 1/2010 | Fischer | |
| 2011/0159755 | A1 | 6/2011 | Dufner et al. | |
| 2016/0039498 | A1* | 2/2016 | Fulop | B63B 7/02<br>114/61.22 |

* cited by examiner

AQUATIC RESCUE DEVICE

RELATED APPLICATIONS

This patent application claims the benefit of U.S. Provisional Application No. 62/253,068, filed on Nov. 9, 2015, entitled, "Aquatic Rescue Device," the contents and teachings of which are hereby incorporated by reference in their entirety.

BACKGROUND

In certain climates, it is common for ice to form on a body of water, such as a lake or a river. These ice-covered bodies of water provide recreational opportunities such as ice skating, ice boat sailing, or snow mobile riding. During the course of the activity, accidents can occur, such as involving a person falling through the ice. While time is of the essence in any water rescue, when a person is submerged in ice cold waters time becomes even more critical due to the possibility of hypothermia.

Many types of buoyant rescue devices have been developed which allow a rescuer to reach a drowning victim who has either fallen through the ice or is unable to swim in open water. For example, certain rescue devices are configured as relatively large sled-like structures having relatively large bottom service areas, such as pontoons, for distributing the weight of the device as well as the weight of the victim and the rescuer over a large supporting area. To support the weight of both the victim and the rescuer, conventional pontoons include foam blocks disposed within a shell. The foam blocks typically limit or prevent the weight of the victim and the rescuer from collapsing the pontoons, thereby causing harm to both parties.

SUMMARY

Conventional rescue devices suffer from a variety of deficiencies. For example, conventional rescue devices are configured as relatively large sled-like structures. These structures are buoyant and have relatively large bottom service areas for distributing the weight of the device as well as the weight of the victim and the rescuer over a large supporting area such as an ice surface. Because of its primary purpose, the conventional rescue devices are buoyant so as to be supported on thin ice and to float in water. However, conventional rescue devices relatively bulky which can makes it difficult for an operator to transport to a rescue location and to store during periods of nonuse.

Further, typical rescue device pontoons are conventionally manufactured from a polyethylene shell which contain styrene blocks that provide vertical loading support for a user. The shell is bonded along a seam that extends about a perimeter of the pontoon. While the styrene blocks provide vertical loading support for a user, with such a configuration, the pontoons are fairly heavy.

Inflatable rescue devices have also been developed which do not have the disadvantage of being difficult to transport and store. However, the inflatable devices are subject to deflation as a result of tearing on sharp ice, rocks, or broken bottles. The weight of the victim and the rescuer are not spread uniformly and tends to shift so that the device is not as stable as that of the rigid rescue sleds. Also, due to the yieldable nature of the inflatable device, there is a tendency for the victim to roll off the supporting surface of the device.

By contrast to conventional rescue devices, embodiments of the present innovation relate to an aquatic rescue device.

In one arrangement, the rescue device includes a frame and a set of flotation elements connected to the frame. Each of the flotation elements are configured as substantially hollow, water tight structures. With such a configuration, the flotation elements reduce the weight of the rescue device, thereby allowing the rescue device to be easily transported to a rescue location and stored when not in use. Further, each flotation element includes vertical load supports disposed at various locations within the hollow structure, and along the length, of the flotation elements. The vertical load supports can be configured as relatively thin walled structures which allow the flotation elements to support the weight of a rescue device operator and victim during a rescue operation. The vertical load supports, therefore, maintain the structural integrity of the flotation elements while minimizing the contribution of the weight of the flotation elements to that of the rescue device as a whole.

In one arrangement, each flotation element of the rescue device is configured with a relatively narrow profile. For example, each flotation element can have a length of about 84 inches, a width of about 16 inches, and a depth 34 of about 10 inches. With such a geometric configuration, each flotation element can support a load of about 325 pounds and can provide the rescue device with a total load support of about 650 pounds. Further, the geometric configuration of the flotation elements reduces the overall width of the rescue device compared to conventional rescue devices, thereby allowing the rescue device to be relatively easy to transport and store.

In one embodiment of the innovation, a rescue device includes a frame and at least one flotation element connected to the frame. The at least one flotation element defines a chamber containing a volume of air and includes at least one vertical load support extending between a first flotation element portion and an opposing second flotation element portion of the flotation element.

BRIEF DESCRIPTION OF THE DRAWINGS

The foregoing and other objects, features and advantages will be apparent from the following description of particular embodiments of the innovation, as illustrated in the accompanying drawings in which like reference characters refer to the same parts throughout the different views. The drawings are not necessarily to scale, emphasis instead being placed upon illustrating the principles of various embodiments of the innovation.

DETAILED DESCRIPTION

Figure 1:
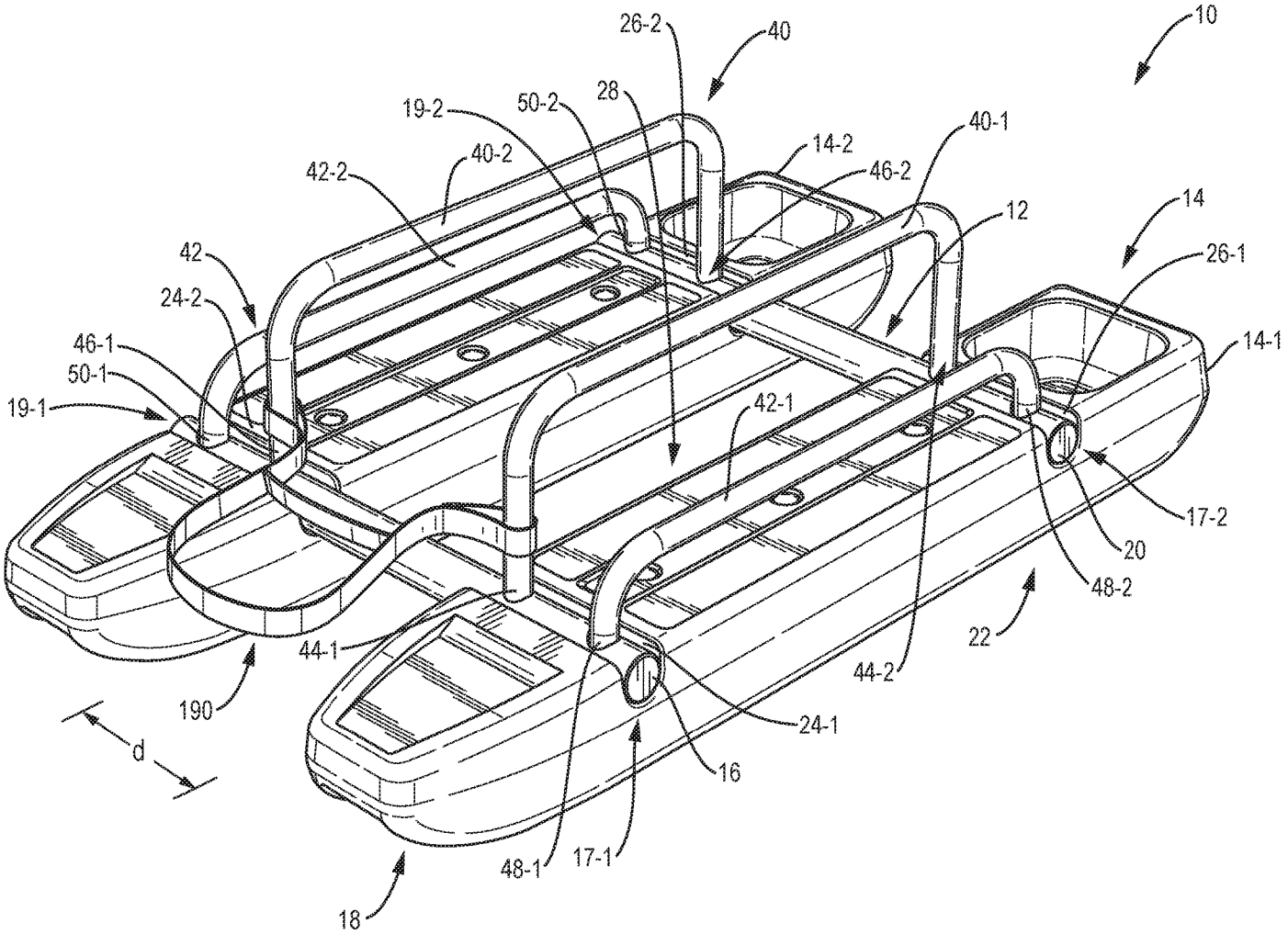
FIG. 1 illustrates a top perspective view of a rescue device, according to one arrangement.

Embodiments of the present innovation relate to an aquatic rescue device. In one arrangement, the rescue device includes a frame and a set of flotation elements connected to the frame. Each of the flotation elements are configured as substantially hollow, water tight structures. With such a configuration, the flotation elements reduce the weight of the rescue device, thereby allowing the rescue device to be easily transported to a rescue location and stored when not in use. Further, each flotation element includes vertical load supports disposed at various locations within the hollow structure, and along the length, of the flotation elements. The vertical load supports can be configured as relatively thin walled structures which allow the flotation elements to support the weight of a rescue device operator and victim during a rescue operation. The vertical load supports, therefore, maintain the structural integrity of the flotation elements while minimizing the contribution of the weight of the flotation elements to that of the rescue device as a whole.

FIGS. 1-4 illustrate a rescue device 10, according to one arrangement. As illustrated, the rescue device 10 includes a frame 12 and a set of flotation elements 14 connected to the frame 12. While the rescue device 10 can include any number of floatation elements 14, in the arrangement shown the rescue device 10 includes a first flotation element 14-1 and a second flotation element 14-2.

The frame 12 is configured to support the flotation elements 14-1, 14-2 in a spaced and substantially parallel relationship. In one arrangement, the frame 12 includes a first cross member 16 connected to a first or front portion 18 of the first and second flotation elements 14-1, 14-2 and a second cross member 20 connected to a second or rear portion 22 of the first and second flotation elements 14-1, 14-2. For example, the first and second flotation elements 14-1, 14-2 each define corresponding first channels 24-1, 24-2 that contain the first cross member 16 and define corresponding second channels 26-1, 26-2 that contain the second cross member 20.

As shown, the frame 12 is configured to dispose the first and second flotation elements 14-1, 14-2 at a spaced distance d from each other. For example, the first flotation element 14-1 is connected to a first portion of the frame 12, such as to first ends 17-1, 17-2 of the first and second cross members 16, 20. Further, the second flotation element is connected to a second portion of the frame 12, such as to second ends 19-1, 19-2 of the first and second cross members 16, 20. With such positioning, the cross members 16, 20 and the first and second flotation elements 14-1, 14-2 define an opening 28 there between. In one arrangement, the opening 28 allows a rescue device operator to walk along a frozen or ice surface that supports the rescue device 10 during a rescue procedure. In another arrangement, the opening 28 is configured to receive a platform or other surface to provide support to the rescue device operator when guiding the rescue device 10 in a body of water during a rescue procedure.

The rescue device 10 can also include a first set of rails 40 and a second set of rails 42, as shown. In one arrangement, the first set of rails 40 are configured as guard rails which limit or prevent either a rescue device operator or a rescued person from falling from the rescue device 10. Further, the second set of rails 42 can be configured as carry rails, which allow a rescue device operator to move and/or carry the rescue device 10, such as to a site for a rescue procedure. Alternately, the second set of rails can be configured as storage rails which allow an operator to hang the rescue device from a wall, such as via a set of hooks, when not in use.

While the first and second sets of rails 40, 42 can be manufactured in a variety of ways, in one arrangement each rail of the first and second sets of rails 40, 42 is manufactured from a cylindrical tube of thermoplastic material, such as polyvinyl chloride, formed as a substantial U-shape. The cylindrical tubes can be configured as hollow tubes to minimize the overall weight of the rescue device.

Each of the first and second sets of rails 40, 42 can include any number of rails within the sets. For example, the first set of rails 40 can include a first rail 40-1 connected to the first flotation element 14-1 and a second rail 40-2 connected to the second flotation element 14-2. Further, the second set of rails 42 can include a first rail 42-1 connected to the first flotation element 14-1 and a second rail 42-2 connected to the second flotation element 14-2 where the rails 42-1, 42-2 of the second sets of rails are disposed on either side of the rails 40-1, 40-2 of the first set of rails.

In one arrangement, to provide stability in the coupling of the sets of rails 40, 42 to the rescue device 10, the first and second sets of rails 40, 42 are secured to both the cross members 16, 20 and the first and second flotation elements 14-1, 14-2. Such a connection configuration structurally ties the rails 40, 42 to both the frame 12 and the flotation elements 14, thereby increasing the relative structural integrity of the rescue device 10.

For example, the first rail 40-1 of the first set of rails 40 includes a first end 44-1 connected to both the first cross member 16 and to the front portion 18 of the first flotation element 14-1 and includes a second end 44-2 connected to both the second cross member 20 and to the rear portion 22 of the first flotation element 14-2. Further, the second rail 40-2 of the first set of rails 40 includes a first end 46-1 connected to both the first cross member 16 and to the front portion 18 of the second flotation element 14-2 and includes a second end 46-2 connected to the second cross member 20 and to the rear portion 22 of the second flotation element 14-2.

Further, the first rail 42-1 of the second set of rails 42 includes a first end 48-1 connected to both the first cross member 16 and to a front portion 18 of the first flotation element 14-1 and includes a second end 48-2 connected to both the second cross member 20 and to a rear portion 22 of the first flotation element 14-2. Additionally, the second rail 42-2 of the second set of rails 40 includes a first end 50-1 connected to both the first cross member 16 and to the front portion 18 of the second flotation element 14-2 and includes a second end 50-2 connected to the second cross member 20 and to the rear portion 22 of the second flotation element 14-2.

The set of flotation elements 14 are configured to provide buoyancy to the rescue device 10 while minimizing the weight of the rescue device 10 and providing a stable support surface for a rescue device operator and victim. The following provides a description of an example embodiment of the flotation elements 14.

Figure 6:
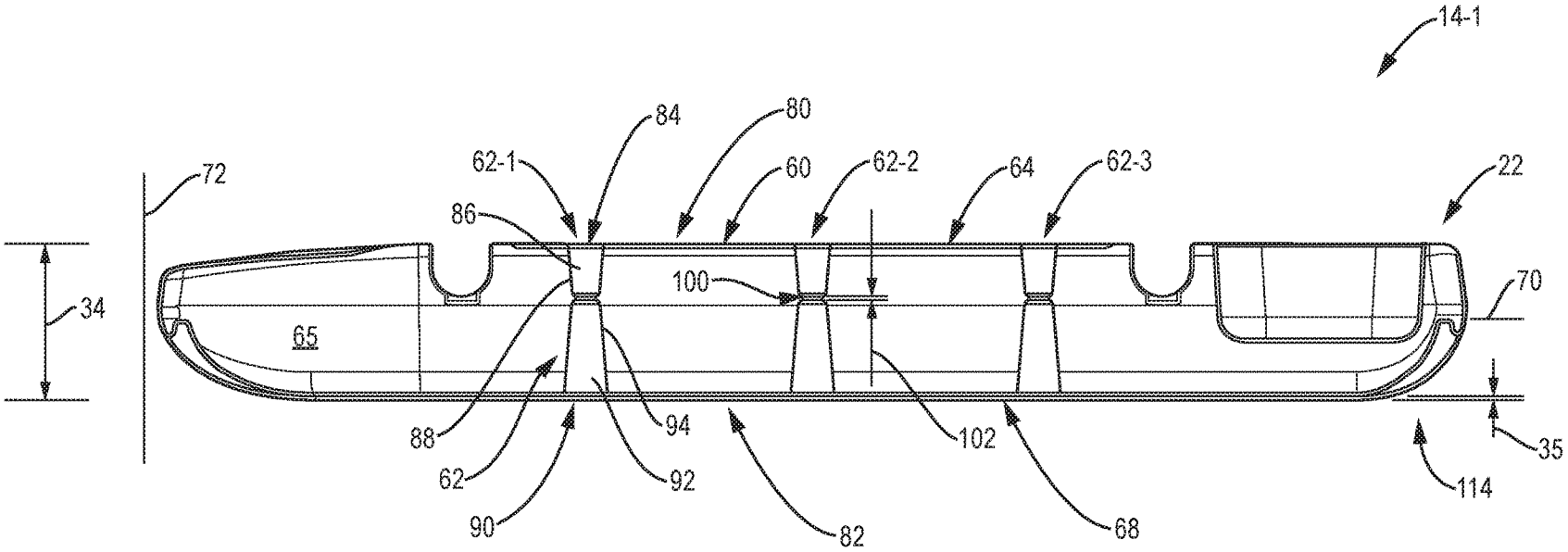
FIG. 6 is a side sectional view of the flotation element of FIG. 5, according to one arrangement.
Figure 7:
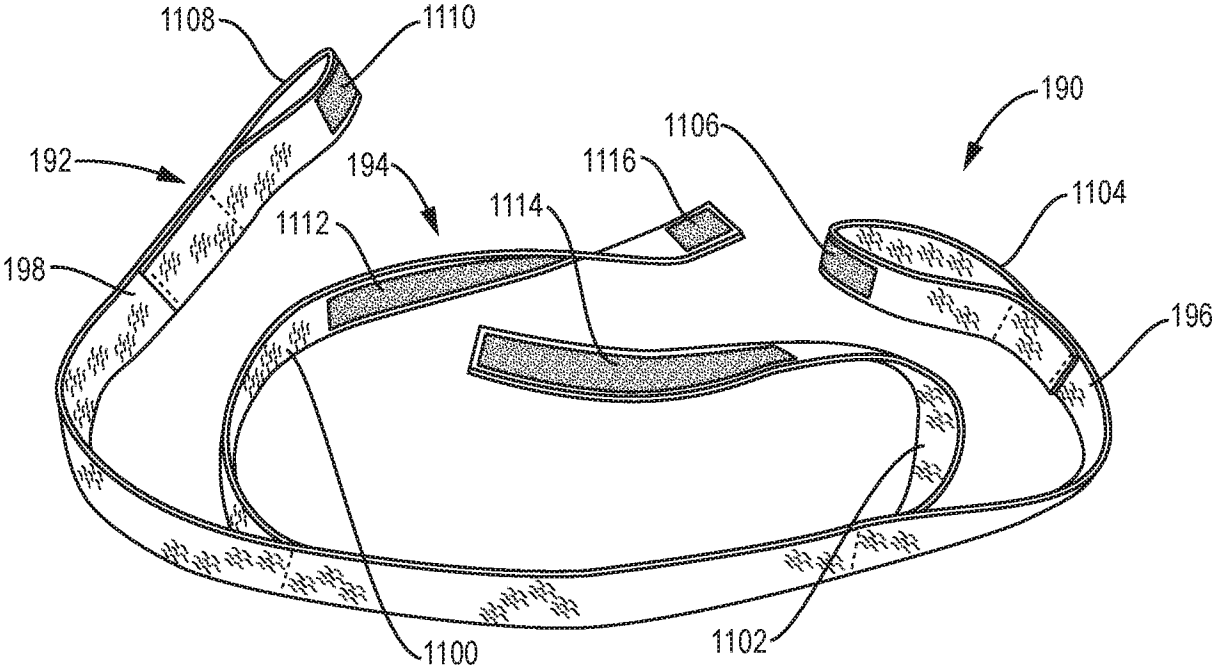
FIG. 7 illustrates a harness of the rescue device of FIG. 1, according to one arrangement.

In one arrangement, to provide buoyancy to the rescue device 10, each of the flotation elements 14-1, 14-2 are configured as substantially hollow, water tight structures. For example each of the floatation elements 14-1, 14-2 can be manufactured using a rotational molding or rotomolding process. During the manufacturing process, a manufacturer utilizes a two cavity mold. For example, each mold element of the two cavity mold corresponds to the outer size, shape, and geometry of a corresponding first, or top, flotation element portion 64 and a corresponding second, or bottom flotation element portion 68, as indicated in FIG. 6. The manufacturer closes the mold elements together and injects a powdered resin into the cavity defined by the closed mold elements. The manufacturer then heats the two cavity mold, such as by placing the mold in an oven, to melt the powdered resin and rotates the mold during the heating process. This rotation distributes the melted resin along the walls of the two cavity mold and causes the melted resin to take the shape of the first and second flotation element portions 64, 68. In one arrangement the wall thickness of portions 64, 68 is about 0.125 inches at the end of the manufacturing process.

The rotational molding manufacturing process results in substantially hollow flotation elements 14-1, 14-2 which are leak tight, thereby limiting or preventing water from entering the hollow flotation elements 14-1, 14-2 during operation. An example of the first flotation element 14-1 is provided in FIGS. 5 and 6 and is described below.

As illustrated, the flotation element 14-1 includes a shell 60 that is formed as a substantially hollow structure. As shown, the shell 60 includes a first flotation element portion 64 and an opposing second flotation element portion 68 and further defines a chamber 65 containing a volume of air. The chamber 65 extends between the first and second flotation element portions 64, 68 along a longitudinal axis 70 of the flotation element 14-1. With such a configuration, the chamber 65 can distribute the volume of air substantially evenly throughout the flotation element 14-1 to maintain buoyancy of the flotation element 14-1 along its length 30 and width 32. Further, with the absence of internal flotation elements, the configuration of the chamber 64 reduces the overall weight of the rescue device 10 compared to conventional devices.

The geometric configuration of the flotation elements 14-1, 14-2 also contributes to the buoyancy of the rescue device 10. For example, with continued reference to FIGS. 5 and 6 and taking the first flotation element 14-1 as an example, the first flotation element 14-1 has a length 30 of about 84 inches, a width 32 of about 16 inches, a depth 34 of about 10 inches and a wall thickness 35 of about 0.125 inches. With such a configuration, the first flotation element 14-1 can support a load of about 325 pounds, thereby providing the rescue device 10 with a total load support of about 650 pounds. Such load support is greater than that provided by conventional devices. As such, the configuration of the first and second flotation elements 14-1, 14-2 increases the amount of load carrying capability, and stability, of the rescue device 10 and allows the rescue device 10 to remain afloat in a body of water during a rescue operation.

Further, the geometric configuration of the flotation elements 14-1, 14-2 also allows for relatively easy and clean deployment of the rescue device 10 during a rescue operation. For example, the length 30, width 32, and depth 34 of the flotation elements 14-1, 14-2 as provided above are configured to provide a relatively narrow profile to the rescue device 10. This allows the rescue device 10 to be easily transported to a rescue location and deployed by one or more rescue device operators.

Each of the flotation elements 14-1, 14-2 are configured support the weight of a rescue device operator and a victim during a rescue procedure. For example, with continued reference to FIGS. 5 and 6, the shell 60 includes vertical load supports 62 that extend within the chamber 65 between the first flotation element portion 64 and the second flotation element 68 along a vertical axis 72. While each flotation element 14-1, 14-2 can include any number of vertical load supports 62, in one arrangement, the flotation elements 14-1, 14-2 can each include three vertical load supports 62-1 through 62-3 distributed along the longitudinal axis 70.

The vertical load supports 62 can be configured with a variety of geometries. In one arrangement, as will be described below, each of the vertical load supports 62 includes opposing conically-shaped or cylindrically-shaped elements that define hollow cavities or chambers 86, 92. With such a configuration, the vertical load supports 62 minimize the weight of the flotation elements 14 while maintaining structural integrity of the flotation elements 14, thereby minimizing collapse of the flotation elements in use.

Figure 5:
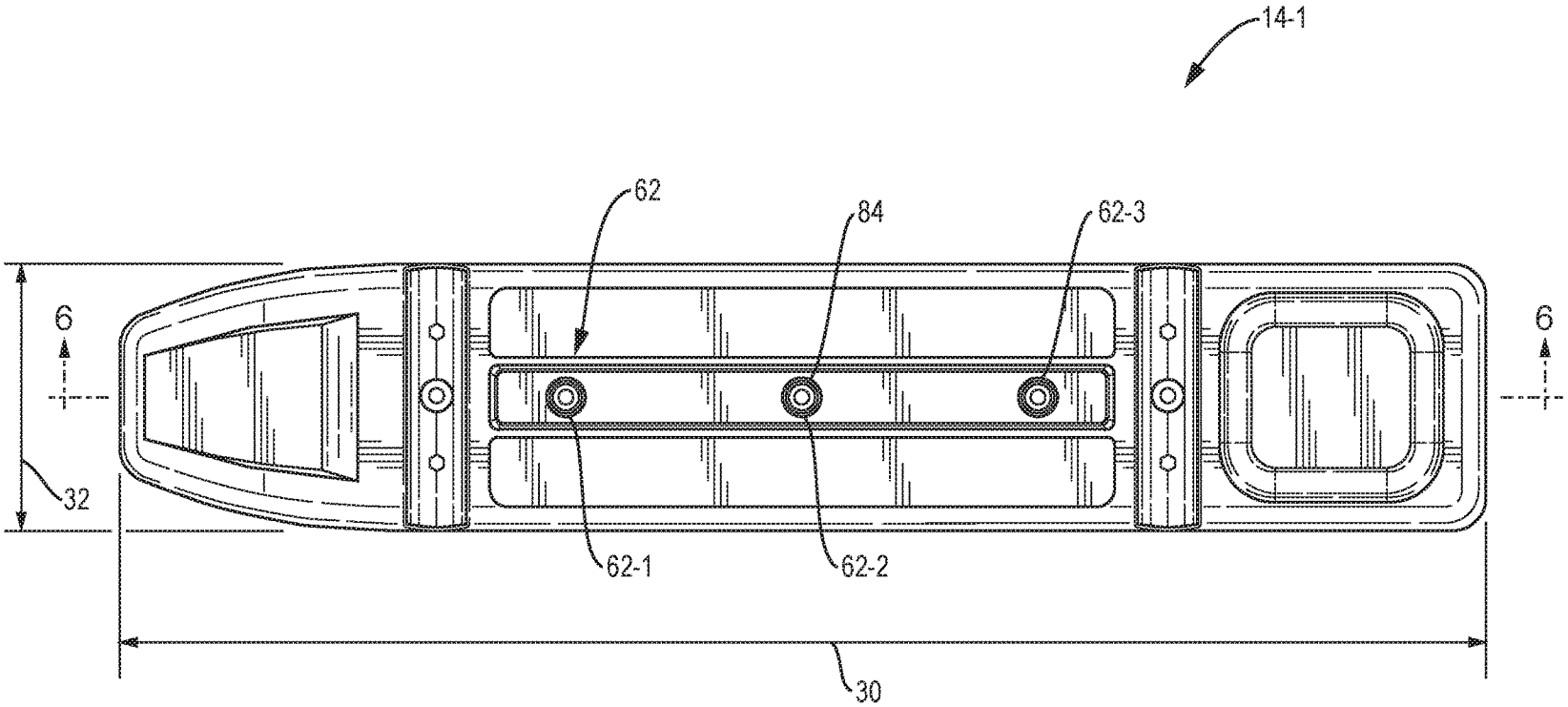
FIG. 5 is a top view of a flotation element of the rescue device of FIG. 1, according to one arrangement.

In one arrangement, each vertical load support 62 is integrally formed with the first flotation element portion 64 and the second flotation element portion 68. For instance, during a rotomolding process, the two cavity mold can form each vertical load support 62 as conical or cup-shaped elements. As indicated in FIGS. 5 and 6, each vertical load support 62 can define a first opening 84 relative to a first or upper surface 80 of the first flotation element portion 64 and a first chamber 86 defined by a first load support wall 88. Each vertical load support 62 can also define a second opening 90 relative to a second or bottom surface 82 of the second flotation element portion 68 and a second chamber 92 defined by a second load support wall 94. The first and second load support walls 88, 94 meet at a central location 100 that defines an interposing wall 102 between the first and second load support walls 88, 94. In such a case, the total wall thickness of the central location 100 and the interposing wall 102 is more than twice the thickness of the first and second load support walls 88, 94. For example, in the case where the support wall thickness is about 0.125 inches and the interposing wall thickness is about 0.218 inches, the thickness of the vertical load support 62 at the central location is about 0.343 inches.

With such a configuration, each of the vertical load supports 62 include relatively thin walled structures which distribute a load from the upper surface 80 of the first flotation element portion 64 to the bottom surface 82 of the of the second flotation element portion 68. This allows the flotation elements 14 to support the weight of a rescue device operator and victim, such as applied through the frame 12 by the rescue device operator and victim, during a rescue operation. The vertical load supports 62, therefore, maintain the structural integrity of the flotation elements 14 while minimizing the contribution of the weight of the flotation elements to that of the rescue device as a whole.

Each flotation element 14-1, 14-2 can be configured with a variety of additional features to aid the rescue device operator during a rescue operation. For example, with reference to FIG. 4 and taking the first flotation element 14-1 as an example, the first flotation element 14-1 can include a compartment 110 disposed at a rear location 22. The compartment 110 can be formed during the rotational molding process and is configured to carry items to aid in a rescue operation, such as rope (shown) or a first aid kit (not shown). The compartments 110 can be covered with a netting 112 to prevent the items held in the compartment 110 from falling out during a rescue operation.

Figure 2:
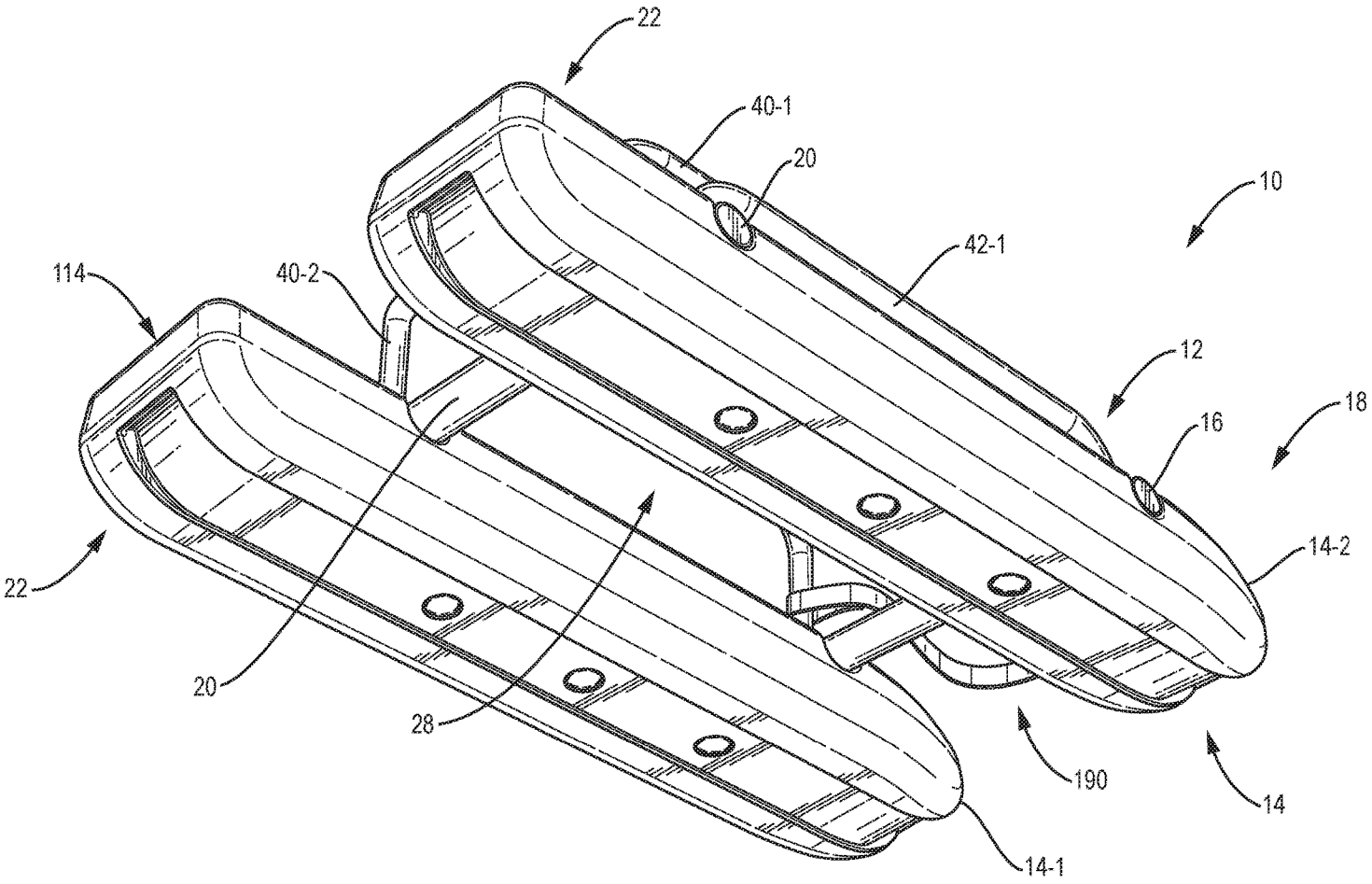
FIG. 2 illustrates a bottom perspective view of the rescue device of FIG. 1, according to one arrangement.

In another example, with reference to FIGS. 2 and 6 and taking the first flotation element 14-1 as an example, the first flotation element 14-1 includes a handle portion 114 disposed at a rear location 22 of the first flotation element 14-1. The handle portion 114 is configured to allow a rescue device operator to readily remove the rescue device 10 from a storage location or vehicle and carry the rescue device 10 to a rescue location. While the handle portion 114 can be configured in a variety of ways, in one arrangement, the handle portion 114 can be formed during the rotational molding process and defined as a cavity formed in the first flotation element 14-1.

In another example, returning to FIG. 4, the upper surfaces 80 of the flotation elements 14 are configured as textured surfaces to assist in the rescue device operator in maintaining his footing during a rescue operation. For example, the upper surfaces 80 can include anti-skid pads 116 which are adhered to the upper surfaces 80 of the flotation elements 14. Alternately, the upper surfaces 80 can include a roughened texture (not shown), such as integrally formed in the flotation elements 14.

In one arrangement, returning to FIGS. 1-4, the rescue device 10 also includes a retaining harness 190 configured to secure a victim to the rescue device 10 during a rescue operation. For example, the retaining harness 190 includes a first webbing 192 a second webbing 194. The webbings 192 and 194 are made of strong woven material. The webbings 192 and 194 are joined, i.e. by sewing, along a midpoint section of both webbings 192, 194 so that four distinct straps are formed. First and second straps 196 and 198, respectively, are formed from the webbing 192 while third and fourth straps 1100 and 1102, respectively, are formed from the webbing 194. A free end of the first strap 196 is formed into a loop 1104 which encircles a portion of the first rail 40-1 of the first set of rails 40. The strap 196 also includes a fastening element 106. The free end of the second strap 198 is formed into a loop 1108 which encircles a portion of the second rail 40-2 of the first set of rails 40. The strap 198 also includes a fastening element 1110.

The third strap 1100 includes a first primary fastening element 1112 on one side of the strap and a secondary fastening element 1116 on the opposite side of the strap. The fourth strap 1102 includes a primary second fastening element on one side of the strap (not shown) and a secondary fastening element 1114 on the opposite side of the strap. The second primary fastening element 1114 is complementary to the primary first fastening element 1112 so that when the fastening elements 1112 and 1114 are joined, the straps 1100 and 1102 form a loop for encircling and retaining a victim as indicated in FIG. 1. The secondary fastening elements 1116 and 1114 are complementary to the fastening elements 1106 and 1110 for securing the ends of the straps 1110 and 1102 to the ends of the straps 196 and 198 so that the straps are secured during periods of nonuse. The preferred fastening mechanism can include a textile hook and loop fastening material, such as VELCRO, which is sewn or otherwise secured to the straps.

In use, a rescue device operator can deploy the rescue device 10 to retrieve a potential drowning victim from a body of water. If, for example, the victim is to be rescued from a hole in thin ice, the operator places the rescue device 10 on the ice so that the flotation elements 14-1, 14-2 rest on the surface of the ice near the shore. The device operator then advances the rescue device 10 toward the victim. This is accomplished by grasping the first and second rail 40-1, 40-2 of the first set of rails 40 so that a majority of the rescuer's weight is transferred through the frame 12 to the flotation elements 14-1, 14-2 which extend over a relatively large surface area on the ice, while the rescuer's feet contact the ice in the space 28 between the flotation elements 14-1, 14-2. This enables the rescuer to push or walk on the surface of the ice to advance the rescue device 10 toward the victim with only enough downward pressure on the ice to create traction but not to cause the ice to break.

When the rescuer has advanced the rescue device 10 to the edge of the hole in the ice where the victim is located, the rescuer stands on the device 10 with one foot on each of the flotation elements 14-1, 14-2 and grabs the victim's hands or clothing and pulls the victim onto the first cross member 16 of the frame 12. This positions the victim on top of the mid-portions of the webbing 192 and 194 of the harness 190. The device operator then places straps 1100 and 1102 over the victim and fastens the straps together to form a loop which encircles the torso of the victim. This secures the victim to the rescue device 10.

The rescuer then turns 180° and advances the rescue device 10 towards the shore in the same manner as the rescue device 10 was advanced toward the victim. The rescue device operator will now be at the opposite end of the rescue device 10 from the victim (i.e., facing the second or rear portion 22 of the first and second flotation elements 14-1, 14-2) so that the combined weight of the victim and rescue device operator will be relatively evenly distributed between both ends 18, 22 of the rescue device 10. If additional rescuers are at the shore, the rescue device 10 containing the victim and rescuer can be pulled toward shore by these additional rescuers.

Based upon the utilization of a substantially hollow chamber 65 for each of the flotation elements 14, the configuration of the flotation elements 14 reduces the weight of the rescue device 10, thereby allowing the rescue device 10 to be easily transported and deployed at a rescue location. Further, each flotation element 14-1, 14-2 includes vertical load supports 62 disposed at various locations within the hollow chamber 65 and along the length of the flotation elements 14-1, 14-2. The vertical load supports 62 are structurally rigid, which allows the flotation elements 14-1, 14-2 to support the weight of the rescue device operator and victim during a rescue operation. For example, the vertical load supports 62 are configured to distribute weight applied by the rescue device operator to the frame 12, via the first and second rail 40-1, 40-2, from the upper surface 80 to the bottom surface 82 of the flotation elements 14-1, 14-2. The vertical load supports 62, therefore, maintain the structural integrity of the flotation elements 14-1, 14-2 during use while minimizing the contribution of the weight of the flotation elements 14-1, 14-2 to that of the rescue device 10 as a whole.

The rescue device 10 can include additional features that contribute to the stability of the device 10 during operation. The following provides a description of various examples of such features.

Figure 4:
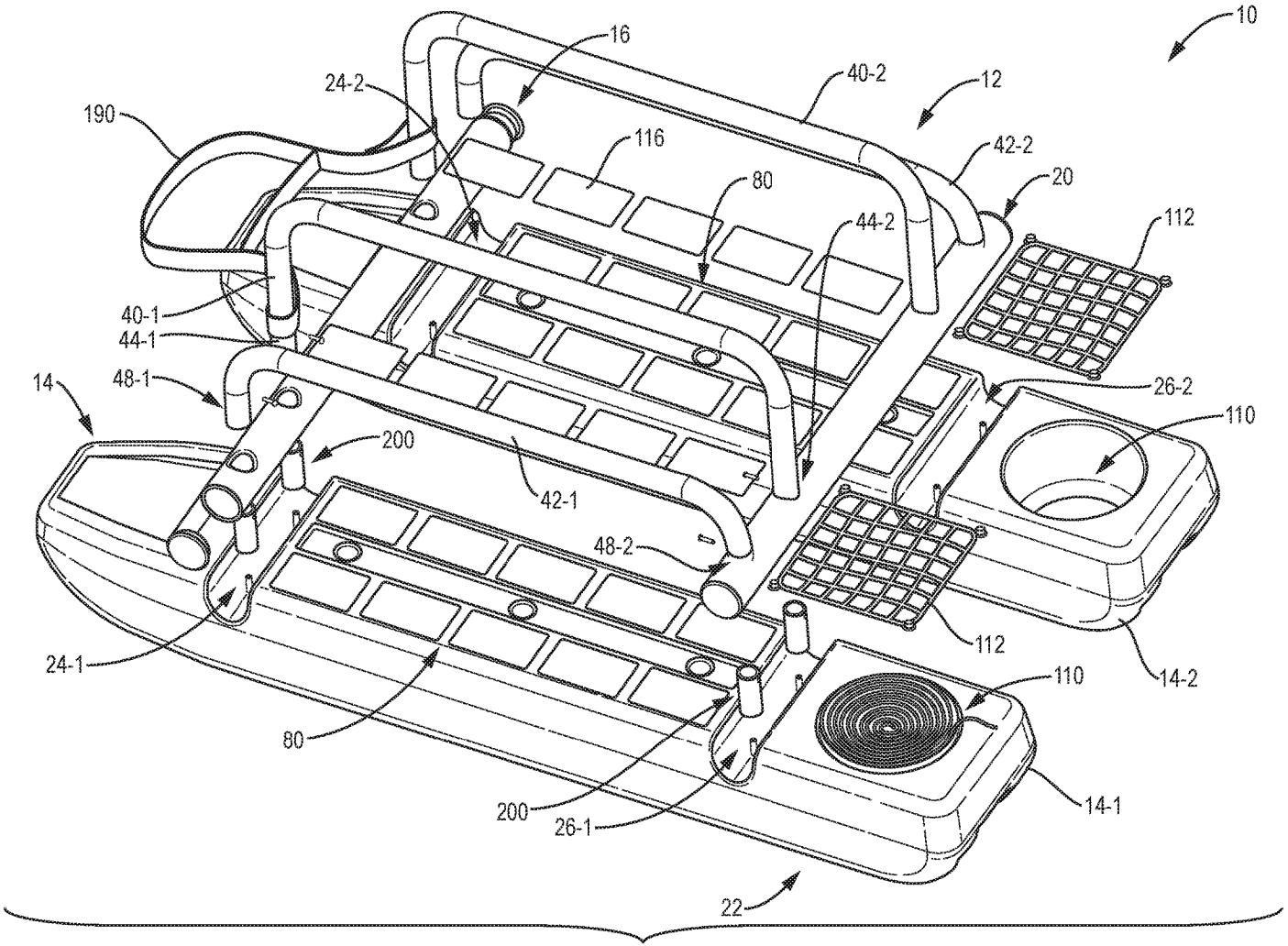
FIG. 4 illustrates an exploded perspective view of the rescue device of FIG. 1, according to one arrangement.

For example, as provided above, the ends of the first and second sets of rails 40, 42 are connected to the respective cross bars 16, 20 and flotation elements 14-1, 14-2. In one arrangement, to secure these elements together in a substantially rigid configuration, each of the first and second sets of rails 40, 42 includes two separate connection assemblies 200, such that the rescue device 10 includes a total of eight connection assemblies, as indicated in FIG. 4.

Figure 8A:
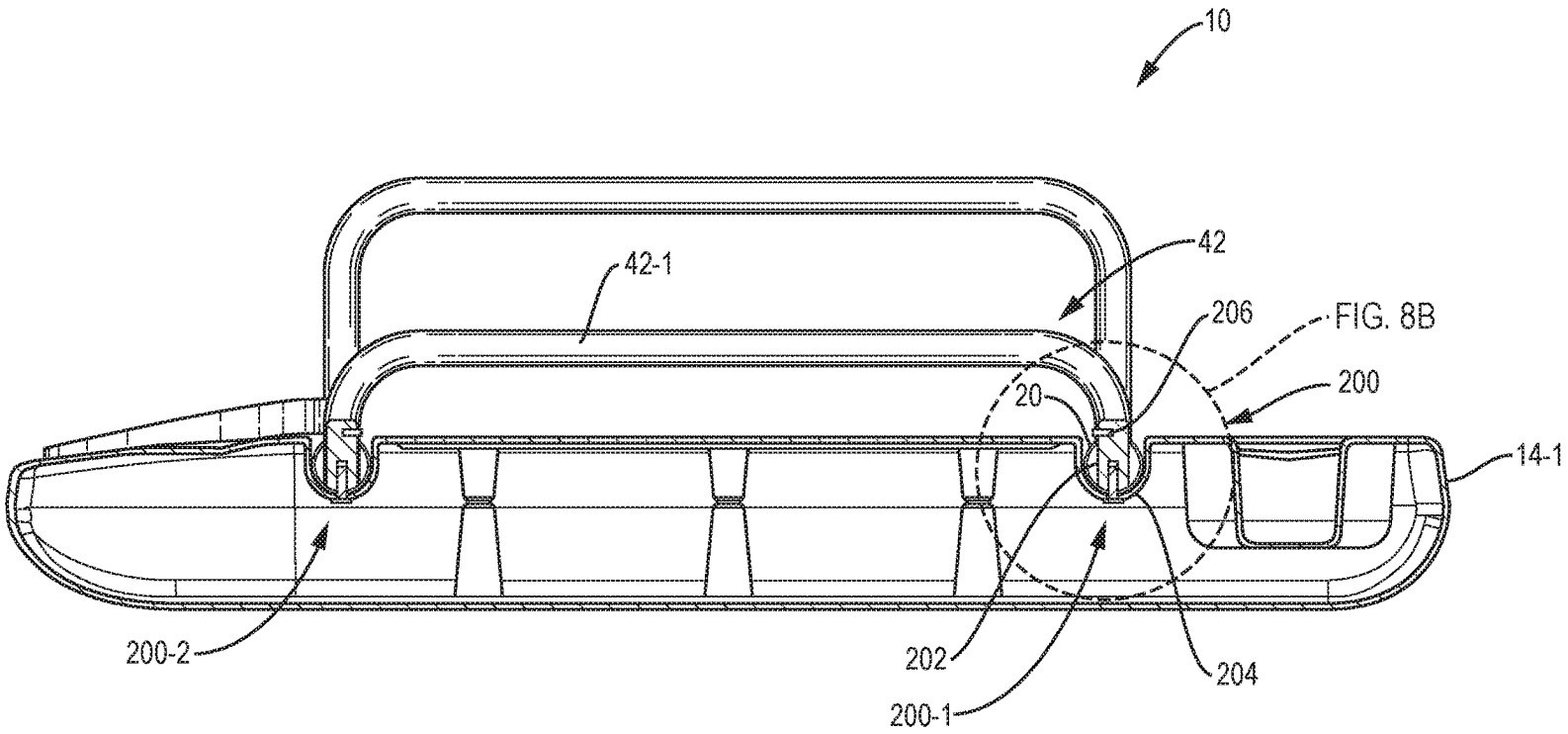
FIG. 8A illustrates a sectional view of the rescue device of FIG. 1 showing a rail connection assembly according to one arrangement.

In one arrangement, with reference to FIG. 8A and taking the first rail 42-1 of the first set of rails 42 as an example, the first rail 42-1 includes a first connection assembly 200-1 and a second connection assembly 200-2. Each connection assembly 200 includes a sleeve 202 and a first connector 204 configured to connect the sleeve 202 and a cross member, such as cross member 20, to a corresponding flotation element, such as the first flotation element 14-1. Each connection assembly 200 also includes a second connector 206 configured to connect the rail, in this case first rail 42-1, to the sleeve 200.

Figure 8B:
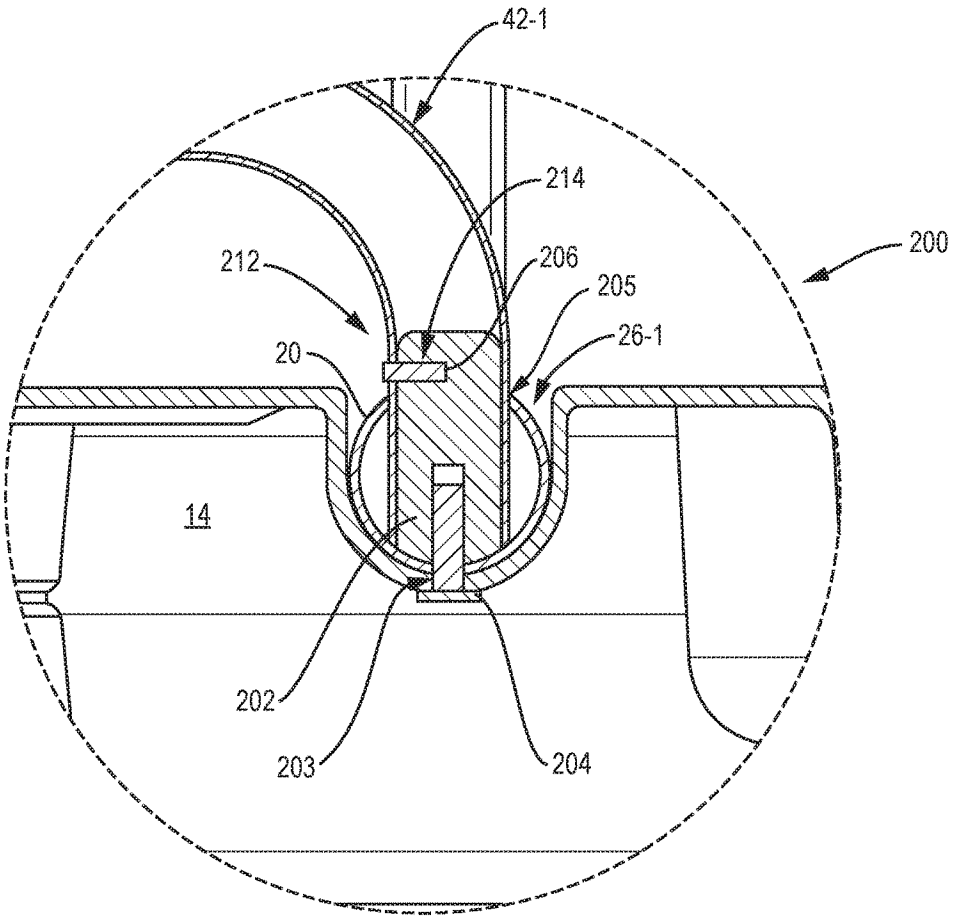
FIG. 8B illustrates a sectional view of the rail connection assembly of FIG. 8A, according to one arrangement.
Figure 9:
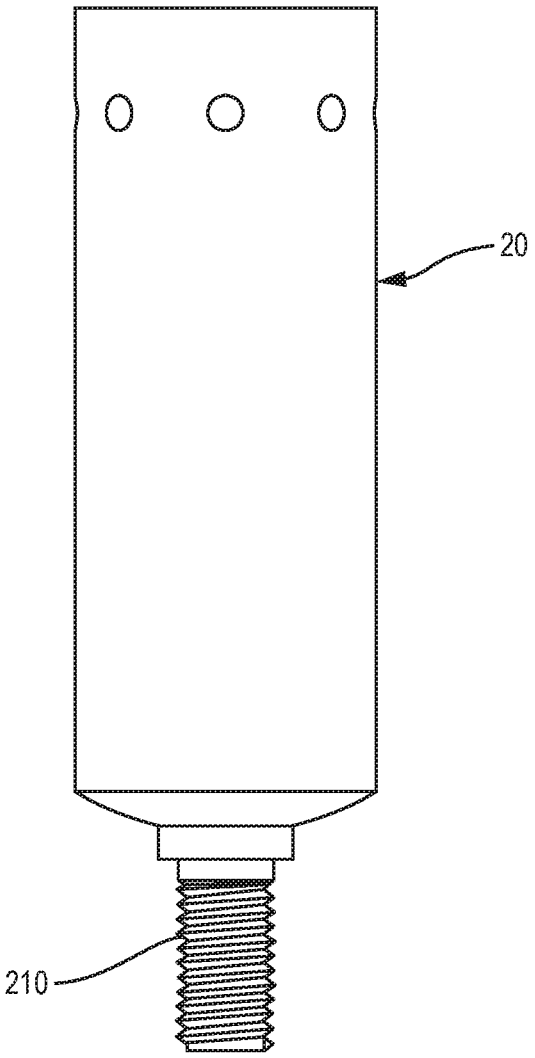
FIG. 9 illustrates a rail sleeve of the rail connection assembly of FIGS. 8A and 8B, according to one arrangement.

With reference to FIG. 8B, the first connector 204 is configured to mate the sleeve 202 with the flotation element 14 and to secure the sleeve 202 to the cross member 20. For example, in the arrangement shown, the first connector 204 can configured as male connector component, such as a bolt, which is in-molded as part of the flotation element 14. In such a case, the first connector 204 is configured to mate with a corresponding female connector component of the sleeve 202, such as a threaded opening. In another arrangement, the first connector 204 is configured as a female connector component, such as a threaded element which is in-molded as part of the flotation element 14. In such a case, the first connector 204 is configured to mate with a corresponding male connector component 210 of the sleeve 202, such as illustrated in FIG. 9.

With reference to the example shown in FIG. 8, during an assembly process, a manufacturer aligns a first opening 203 of the cross member 20 with the first connector 204, inserts the first connector 204 into the first opening 203 and disposes the cross member 20 into the channel 26-1. Next, the manufacturer inserts the sleeve 202 into a second opening 205 of the cross member 20 and threads the corresponding female connector element of the sleeve 202 onto the first connector 204. With such connection, the sleeve 202 and cross member 20 are secured to the flotation element 14-1 with the sleeve 202 extending from the second opening 205 of the cross member 20.

The sleeve 202 is further configured as a substantially cylindrically shaped structure having an outer diameter that is less than the diameter of the opening 205 of the cross member 20 and less that an inner diameter of the end of the first rail 42-1. With such a configuration, during assembly, the tubular end of the first rail 42-1 inserts within the opening 205 of the cross member 20 and around the sleeve 202. In one arrangement, the wall of the first rail 42-1 forms a friction fit with the wall opening 205 of the cross member and the outer wall of the sleeve 202.

With the end of the first rail 42-1 disposed about the sleeve 202, a lateral opening 212 of the first rail 42-1 aligns with a corresponding lateral opening 214 of the sleeve 202. With such alignment, the manufacturer can insert the second connector 206, such as a threaded fastener, into the openings 212, 214 to connect first rail 42-1 to the sleeve 200. As a result of connecting the flotation element, the cross member 20, and the sleeve 42-1 together as a unit, the connection assembly 200 provides a level of structural stability to the rescue device 10.

As provided above, the rescue device 10 includes a retaining harness 190 configured to secure a victim to the rescue device 10 during a rescue operation. In one arrangement, the rescue device 10 is configured to act in conjunction with the retaining harness 190 to secure the victim to the device 10 in order to minimize movement or slippage of the victim from the device 10.

Figure 10:
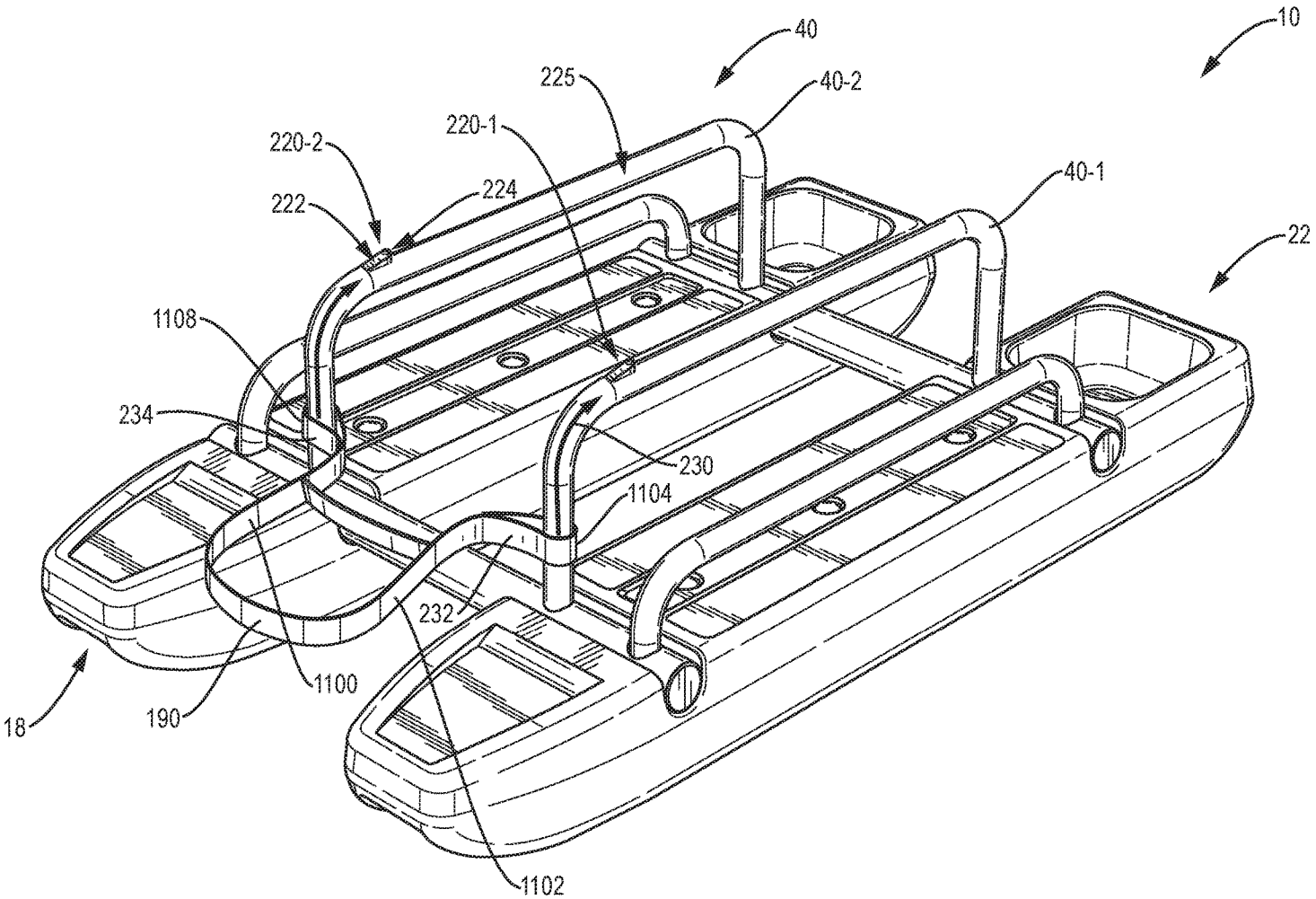
FIG. 10 illustrates a top perspective view of a rescue device having a set of harness retainers, according to one arrangement.

For example, with reference to FIG. 10, each of the first and second rails of the guard rails 40 include a harness retaining mechanism 220. For example, the first rail 40-1 includes a first harness retaining mechanism 220-1 and the second rail 40-2 includes a second harness retaining mechanism 220-2. Taking the second harness retaining mechanism 220-2 as an example, the mechanism 220-2 includes an engagement face 222 and a vertical face 224. The engagement face 222 extends from a top surface 225 of the second rail 40-2 at angle, such as at an angle of between about 5° and 10°. The distance between the engagement face 222 and the top surface 225 of the rail 40-2 increases along a direction from a front portion 18 of the rescue device 10 to a rear portion 22 of the device 10. The vertical face 24 extends vertically from a back portion of the engagement face to the top surface 225 of the second rail 40-2.

In use, each of the first and second harness retaining mechanisms 220-1, 220-2, are configured to engage and secure corresponding first and second ends 1104, 1108 of the retaining harness 190 to the rails 40-1, 40-2. For example, once a victim has been secured to the retaining harness 190, the device operator can further pull the victim onto the rescue device 10 by grasping the straps 1100 and 1102 and pulling the victim upwardly so that the loops 1104 and 1108 slide along the corresponding first and second rails 40-1, 40-2 along direction 230. As the loops 1104, 1108 reach the corresponding harness retaining mechanisms 220-1, 220-2, the top portions 232, 234 of the loops 1104, 1108 slide along the engagement faces 222 and past the vertical faces 224. With such positioning of the loops 1104 and 1108, the vertical faces 224 limit the loops 1104, 1108, and the retaining harness 190, from sliding back toward the front portion 18 of the rescue device 10. Accordingly, the first and second harness retaining mechanisms 220-1, 220-2 enables the victim to be pulled almost completely out of the water, shifts his weight toward the center of the rescue device 10, and secures the victim to the rescue device 10 in a stable position.

As provided above, the flotation elements 14 are geometrically configured to allow for ease of deployment. For example, the length 30, width 32, and depth 34 of the flotation elements 14-1, 14-2 are configured to provide a relatively narrow profile to the rescue device 10 which allows the rescue device 10 to be easily transported to a rescue location and deployed by one or more rescue device operators. In one arrangement, the flotation elements 14 are also geometrically configured to assist in getting a victim secured to the rescue device 10.

Figure 3:
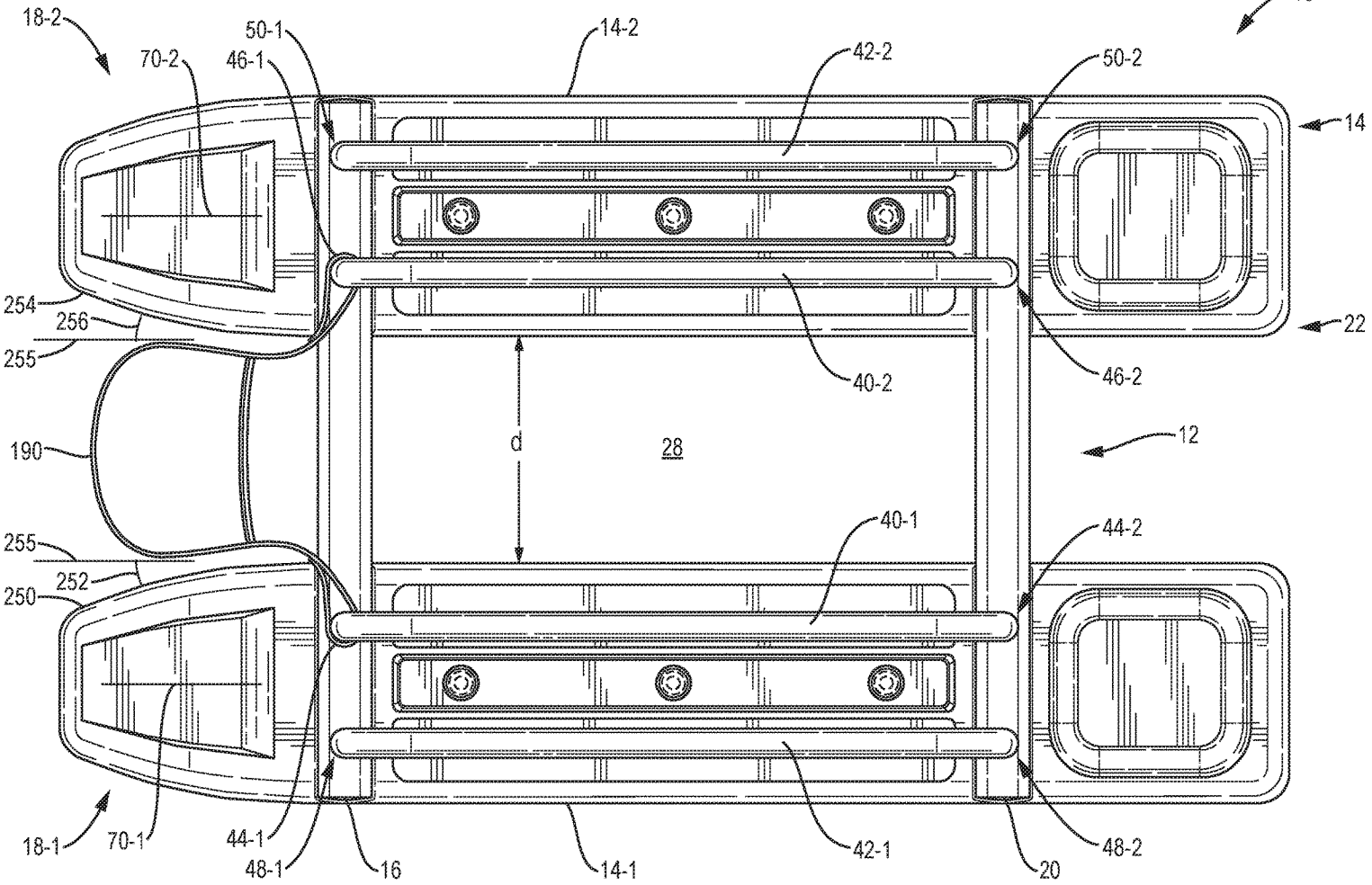
FIG. 3 illustrates a top view of the rescue device of FIG. 1, according to one arrangement.

In one arrangement, with reference to FIG. 3, the front portion 18 of each of the flotation elements are tapered to widen the area available for a victim to engage the rescue device 10. For example, a front end 18-1 of the first flotation element 14-1 includes a vertical face 250 that defines a taper angle 252 extending toward a longitudinal axis 70-1 of the first flotation element relative to a longitudinal axis 252 of the rescue device 10. Further, a front end 18-2 of the second flotation element 14-2 includes a vertical face 254 that defines a taper angle 256 that extends toward a longitudinal axis 70-2 of the second flotation element 14-2 relative to the longitudinal axis 256 of the rescue device 10. Such a tapered configuration of adjoining flotation elements 14-1, 14-2 increases the distance between the front ends 18-1, 18-2 (i.e., a distance greater than d as illustrated). This, in turn, can allow the rescue device operator to more easily engage a victim in the water to pull the victim onto the rescue device 10.

While various embodiments of the innovation have been particularly shown and described, it will be understood by those skilled in the art that various changes in form and details may be made therein without departing from the spirit and scope of the innovation as defined by the appended claims.

What is claimed is:

1. A rescue device, comprising:

a frame; and at least one flotation element connected to the frame, the at least one flotation element defining a chamber containing a volume of air and having at least one vertical load support extending within the chamber between a first flotation element portion and an opposing second flotation element portion of the flotation element;

the at least one vertical load support comprising a first load support element and a second load support element that meet at a central location of the chamber, the first load support element extending from the first flotation element portion toward the central location of the chamber and the second load support element extending from the second flotation element portion toward the central location of the chamber, the first vertical load support element integrally molded with the first flotation element portion and the second vertical load support element integrally molded with the second flotation element portion.

2. The rescue device of claim 1, wherein the at least one flotation element comprises a longitudinal axis and a vertical axis, the chamber defined by the at least one flotation element extending along the longitudinal axis and the at least one vertical load support extending between the first flotation element portion and the second flotation element along the vertical axis.

3. The rescue device of claim 1, wherein the at least one flotation element comprises a first flotation element and a second flotation element, the first flotation element connected to a first portion of the frame and the second flotation element connected to a second portion of the frame, the second flotation element spaced at a distance from the first flotation element.

4. The rescue device of claim 3, comprising a first set of rails having a first rail and a second rail, the first rail of the first set of rails having a first end connected to a first cross member of the frame and to a front portion of the first flotation element and a second end connected to a second cross member of the frame and to a rear portion of the first flotation element, and the second rail of the first set of rails having a first end connected to the first cross member of the frame and to a front portion of the second flotation element and having a second end connected to the second cross member of the frame and to a rear portion of the second flotation element.

5. The rescue device of claim 4, comprising:

a rail connection assembly, comprising:

a sleeve configured to receive one of a first end and a second end of one of the first rail and the second rail of the first set of rails;

a first connector configured to connect the sleeve and a cross member of the frame to one of the first flotation element and the second flotation element; and a second connector configured to connect with one of the first end and the second end of one of the first rail and the second rail of the first set of rails.

6. The rescue device of claim 4, wherein the first rail comprises a first harness retaining mechanism and the second rail comprises a second harness retaining mechanism, the first harness retaining mechanism configured to engage a first end of a retaining harness and the second harness retaining mechanism configured to engage a second end of the retaining harness.

7. The rescue device of claim 4, comprising a second set of rails having a first rail and a second rail, the first rail of the second set of rails having a first end connected to the first cross member of the frame and to the front portion of the first flotation element and a second end connected to the second cross member of the frame and to the rear portion of the first flotation element, and the second rail of the first set of rails having a first end connected to the first cross member of the frame and to the front portion of the second flotation element and having a second end connected to the second cross member of the frame and to the rear portion of the second flotation element.

8. The rescue device of claim 7, comprising:

a rail connection assembly, comprising:

a sleeve configured to receive one of a first end and a second end of one of the first rail and the second rail of the second set of rails;

a first connector configured to connect the sleeve and a cross member of the frame to one of the first flotation element and the second flotation element; and a second connector configured to connect with one of the first end and the second end of one of the first rail and the second rail of the second set of rails.

9. The rescue device of claim 3, wherein:

a front end of the first flotation element comprises a vertical face defining a taper angle extending toward a longitudinal axis of the first flotation element relative to a longitudinal axis of the rescue device and; and a front end of the second flotation element comprises a vertical face defining a taper angle extending toward a longitudinal axis of the second flotation element relative to the longitudinal axis of the rescue device.

10. The rescue device of claim 1, further comprising a compartment disposed at a rear location of the at least one flotation element.

11. The rescue device of claim 1, further comprising a handle portion disposed at a rear location of the at least one flotation element.

12. The rescue device of claim 11, wherein the handle portion is defined as a cavity formed in the at least one flotation element.

13. The rescue device of claim 3, wherein the at least one vertical load support comprises a first set of vertical load supports and a second set of vertical load supports, the first set of vertical load supports being integrally formed with the first flotation element portion and the second flotation element portion of the first flotation element and the second set of vertical load supports being integrally formed with the first flotation element portion and the second flotation element portion of the second flotation element.

14. The rescue device of claim 13, wherein:

the first flotation element comprises a longitudinal axis and a vertical axis, the chamber defined by the first flotation element extending along the longitudinal axis and the first set of vertical load supports extending between the first flotation element portion and the second flotation element of the first flotation element along the vertical axis; and the second flotation element comprises a longitudinal axis and a vertical axis, the chamber defined by the second flotation element extending along the longitudinal axis and the first set of vertical load supports extending between the first flotation element portion and the second flotation element of the second flotation element along the vertical axis.

15. A rescue device, comprising:

a frame;

at least one flotation element connected to the frame, the at least one flotation element defining a chamber containing a volume of air and having at least one vertical load support extending between a first flotation element portion and an opposing second flotation element portion of the flotation element;

wherein the at least one flotation element comprises a first flotation element and a second flotation element, the first flotation element connected to a first portion of the frame and the second flotation element connected to a second portion of the frame, the second flotation element spaced at a distance from the first flotation element; and a first set of rails having a first rail and a second rail, the first rail of the first set of rails having a first end connected to a first cross member of the frame and to a front portion of the first flotation element and a second end connected to a second cross member of the frame and to a rear portion of the first flotation element, and the second rail of the first set of rails having a first end connected to the first cross member of the frame and to a front portion of the second flotation element and having a second end connected to the second cross member of the frame and to a rear portion of the second flotation element, wherein the first rail comprises a first harness retaining mechanism and the second rail comprises a second harness retaining mechanism, the first harness retaining mechanism configured to engage a first end of a retaining harness and the second harness retaining mechanism configured to engage a second end of the retaining harness.

16. A rescue device, comprising:

a frame;

at least one flotation element connected to the frame, the at least one flotation element defining a chamber containing a volume of air and having at least one vertical load support extending between a first flotation element portion and an opposing second flotation element portion of the flotation element;

wherein the at least one flotation element comprises a first flotation element and a second flotation element, the first flotation element connected to a first portion of the frame and the second flotation element connected to a second portion of the frame, the second flotation element spaced at a distance from the first flotation element;

a first set of rails having a first rail and a second rail, the first rail of the first set of rails having a first end connected to a first cross member of the frame and to a front portion of the first flotation element and a second end connected to a second cross member of the frame and to a rear portion of the first flotation element, and the second rail of the first set of rails having a first end connected to the first cross member of the frame and to a front portion of the second flotation element and having a second end connected to the second cross member of the frame and to a rear portion of the second flotation element; and a second set of rails having a first rail and a second rail, the first rail of the second set of rails having a first end connected to the first cross member of the frame and to the front portion of the first flotation element and a second end connected to the second cross member of the frame and to the rear portion of the first flotation element, and the second rail of the first set of rails having a first end connected to the first cross member of the frame and to the front portion of the second flotation element and having a second end connected to the second cross member of the frame and to the rear portion of the second flotation element.

17. The rescue device of claim 1, wherein the at least one vertical load support defines a first opening relative to a first surface of the first flotation element portion and a second opening relative to a second surface of the second flotation element portion.

18. The rescue device of claim 1, wherein:

the first load support element comprises a first load support wall; and the second load support element comprises a second load support wall;

the first load support wall and the second load support wall meeting at the central location and defining an interposing wall between the first load support wall and the second load support wall.

19. The rescue device of claim 4 wherein the first rail of the first set of rails and the second rail of the first set of rails are each configured as a guard rail.

* * * * *